US007496975B1

(12) United States Patent
Tudor

(10) Patent No.: US 7,496,975 B1
(45) Date of Patent: Mar. 3, 2009

(54) STABILIZER STRAPS FOR SPA COVER LIFT

(76) Inventor: E. Jess Tudor, 3100 Merriman Rd., Medford, OR (US) 97501

( * ) Notice: Subject to any disclaimer, the term of this patent is extended or adjusted under 35 U.S.C. 154(b) by 91 days.

(21) Appl. No.: 11/801,048

(22) Filed: May 8, 2007

(51) Int. Cl.
*E04H 4/00* (2006.01)

(52) U.S. Cl. ..... 4/498; 4/503

(58) Field of Classification Search ..... 4/496, 4/498, 503, 580
See application file for complete search history.

(56) References Cited

U.S. PATENT DOCUMENTS 6,000,071 A * 12/1999 Fettes ..... 4/498
7,010,833 B2 * 3/2006 Duarte et al. ..... 4/498

* cited by examiner

*Primary Examiner*—Tuan N Nguyen
(74) *Attorney, Agent, or Firm*—Richard Esty Peterson

(57) ABSTRACT

A pair of stabilizer straps for a spa cover lift mechanism for foldable spa covers used to protect and retain heat in spas and similar apparatus, the stabilizer straps being spaced apart and having one end fastened to the back side of a generally square or rectangular cabinet and an opposite end to the spa cover, wherein a conventional lift mechanism has side arms with first ends pivotally connected to opposite sides of the spa cabinet displaced from the back side and second ends connected to a cross member located at a spa cover fold, the stabilizer straps aiding in evenly displacing a folded cover to the back side of the spa cabinet for use of the spa.

6 Claims, 2 Drawing Sheets

STABILIZER STRAPS FOR SPA COVER LIFT

BACKGROUND OF THE INVENTION

This invention relates to improvements in spa cover lift mechanisms which are typically a mechanical apparatus connected to a spa or, more specifically, to a spa cabinet, and engage a spa cover for removal of the cover.

A conventional spa cover has a thermally insulating core of foam material that is usually braced by one or more internal structural cross members, and covered by a weather resistant sheet material, such as a vinyl composite. The typical cover currently sold combines an insulated foldable cover with a depending skirt that is provided with spaced strap loops on the front and back to interconnect opposite sides of the cover when folded.

It is to be understood that such strap loops can be added to a spa cover not having these appendages or, alternately, other attachment means can be included to connect the stabilizer straps to the spa cover and/or the spa cabinet.

The spa cover lift apparatus for a foldable spa cover of the type described has side arms on each side of the spa that have first ends pivotally connected to the spa and second ends with a cross member that is locatable at the cover fold. The spa cover is folded over the cross member during removal and displaced to the back side of the spa or spa cabinet by manually grabbing the upper portion of one arm and lifting and displacing the arm and carried cover. Despite the rigidity of the members making up the lift apparatus, the mechanism and carried cover cants or twists, moving the cover off center before dropping into the stored position and re-aligning. The spaced stabilizer straps connected to the cover and to the back side of the spa cabinet forces alignment of the displacing cover during the removal process, thereby easing removal and minimizing strain on the components of the lift apparatus.

SUMMARY OF THE INVENTION

The improvement to a spa cover lift mechanism of this invention is a set of stabilizer straps that maintain alignment of a folded spa cover during the removal process. The set of stabilizer straps are preferably a pair of widely spaced straps having first and second ends with one of the ends attached or connectable to the spa cover and the other of the ends attached or connectable to the spa or spa cabinet below the cover. The effective length of the straps is about twelve to fourteen inches, allowing the leading edges of the folded spa cover to kick away and then swing down alongside the back side of the spa during removal. With both straps being of the same length, the leading edges of the folded spa do not cant and the edges uniformly displace to the storage position.

In the preferred embodiment of this invention, the set of stabilizer straps are designed to take advantage of the side squeeze buckle loops that are pre-installed on modern foldable spa covers. The side squeeze buckle loops are typically on the backside edge of a spa cover and are engageable with corresponding straps on the front side edge of the spa cover to retain the edges together when folded. Also, loops may be provided as cover tie-downs or simply for convenience in handling a cover.

When utilizing the pre-installed loops, the stabilizer straps are each conveniently formed of a folded strap that is looped through the squeeze buckle loop with the free ends of the strap pinned to the spa cover cabinet by a screw and trim washer through grommet holes in the overlapped strap ends.

As noted, where the spa cover is not equipped with pre-existing loops, the stabilizer straps can be of similar design with the folded end stitched to the cover and the free ends secured to pins on the spa cabinet.

DETAILED DESCRIPTION OF THE PREFERRED EMBODIMENTS

Figure 1:
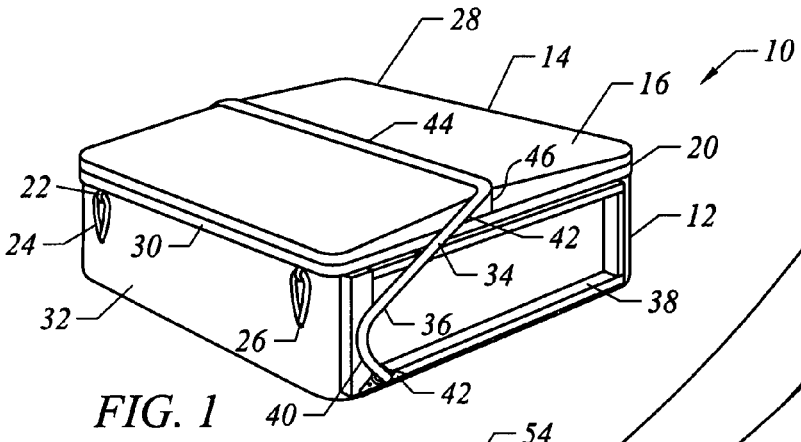
FIG. 1 is a perspective view of the spa cover lift apparatus with a set of stabilizer straps on a spa.
Figure 3A:
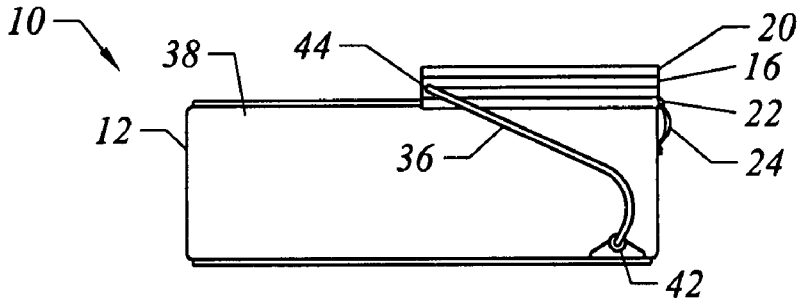
FIG. 3 A-C are schematic views of the side of the spa during removal of a folded cover.
Figure 3B:
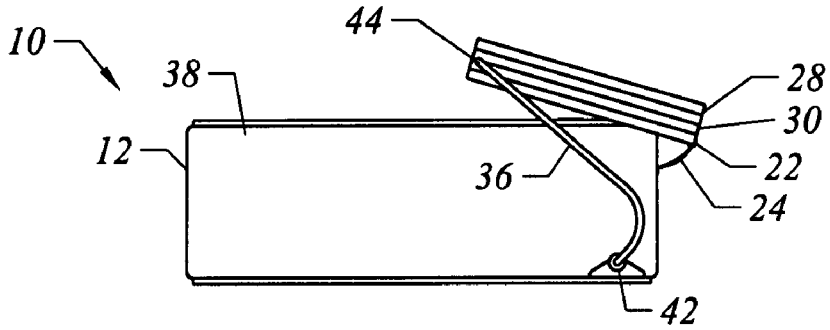
Figure 3C:
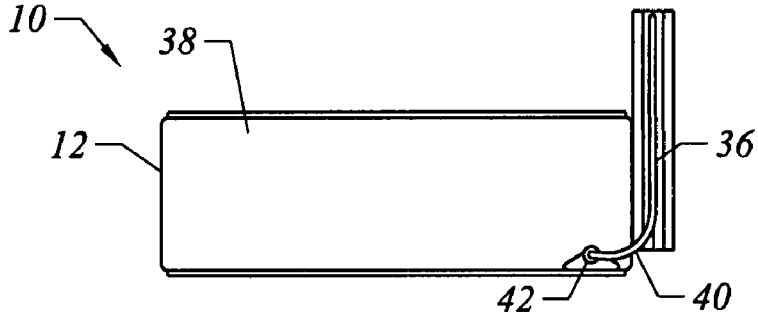

Referring to FIG. 1, a spa 10 has a cabinet 12 with an insulated cover 14 having a top portion 16 containing a thermally insulating core (not visible) covered by a weather resistant covering material 18. The cover 14 also has a skirt portion 20 to protect the spa from debris. The skirt portion 20 includes two spaced squeeze buckle loops 22 that are here adapted to connect to a set of stabilizer straps 24. The pair of stabilizer straps 24 are each looped through a squeeze buckle loop 22. The free ends 26 are overlapped and pinned to the spa cabinet 12 below the location of the squeeze buckle loops. Some slack is provided in the stabilizer straps when installed to permit the front edge 28 and back edge 30 of the folded cover to displace over and swing down along the back side 32 of the spa cabinet 12 when the cover is displaced as shown in FIGS. 3A-C.

In FIG. 1, the spa has a cover lift mechanism 34 with two side arms 36 (one visible) on opposite sides 38 of the spa cabinet 12. One end 40 of the arm 36 has a pivotally mount 42 on each side 38 of the spa cabinet 12 and the other end 42 is connected to a cross member 44 that is located along the fold 46 in the cover 14.

When a user grabs a side arm 36 and lifts and displaces a folded cover, the lift mechanism tends to cant, with the far side of the folded edges 28 and 30, trailing the near side. The stabilizer straps 24 prevent this uneven travel and evenly extend to guide the folded edges 28 and 30 from the initial position shown in FIG. 3A to the storage position shown in FIG. 3C.

Figure 2:
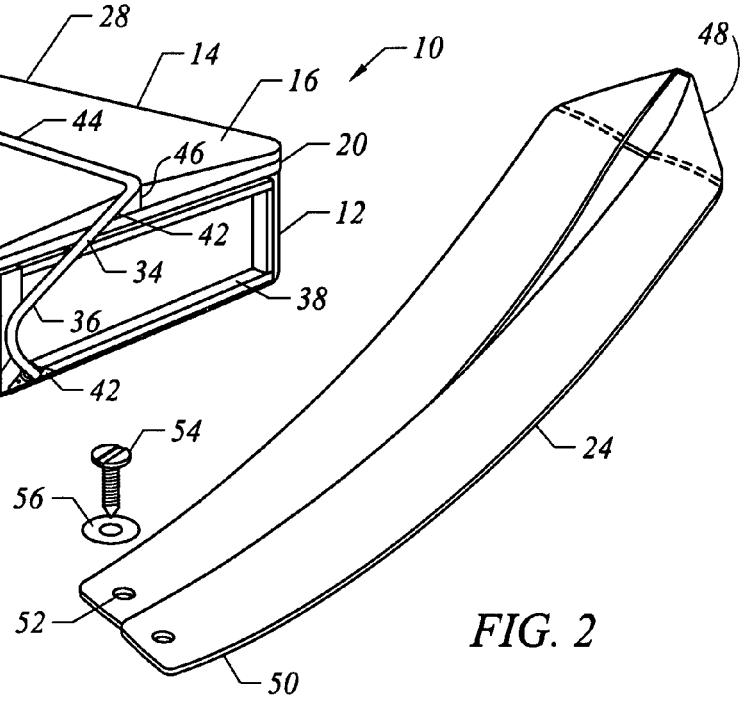
FIG. 2 is an enlarged perspective view of a preferred embodiment of one of the stabilizer straps of FIG. 1.

In the preferred embodiment, the set of stabilizer straps 24 are each configured as shown in FIG. 2. Each strap 24 has a folded and stitched end 48 to provide a loop end that engages the squeeze buckle loop 22 when one of the free ends 50 is threaded through the loop 22 before fastening.

As noted, each strap 24 has a pair of free ends 50 with grommet holes 52. A screw 54 with a finish washer 56 is inserted through the overlapped free ends 50 of each strap 24 to pin the free ends 50 to the exterior of the spa cabinet 12. The stabilizer straps 24 are fabricated of a substantially non-stretchable material, preferably a weather resistant vinyl that matches the material of the cover 14.

Also as noted, the straps can be directly stitched to the skirt of the cover when the cover is not provided with the convenient pre-installed loops shown.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

The invention claimed is:

1. In a spa with a substantially rectangular cabinet and a spa cover lift assembly with an insulated spa cover having a center fold and two half cover segments and having a weather protecting covering wherein the cover lift assembly has a lift mechanism with pivotal side struts on opposite sides of the spa that engage and support the cover at the center fold and pivot the folded cover to one side of the spa when one segment is folded on top of the other segment to provide a common edge, the improvement being a stabilizer system for assisting in the removal of the folded cover comprising:

a set of stabilizer straps with at least two stabilizer straps being spaced apart and having first and second ends with the first ends of the stabilizer straps being attached to the cabinet of the spa and the second ends being attachable to the covering of at least the lower half-segment of the cover at the common edge wherein the length of the straps is selected to limit horizontal displacement of the folded cover when the folded cover is pivoted to the side of the spa wherein the folded cover is thereby downwardly directed to a storage position adjacent the spa.

2. The improved spa cover lift assembly of claim 1 wherein the weather protecting covering has a skirt and the skirt has spaced loops on each of the half cover segments at the common edge wherein the second ends of the stabilizer straps engage the spaced loops on at least one of the cover segments.

3. The improved spa cover lift assembly of claim 2 wherein the stabilizer straps are each formed by a folded over strap with a folded end and paired free ends with the folded end being looped through a spaced loop on the cover and the paired free ends attached to the cabinet.

4. The improved spa cover lift assembly of claim 3 wherein the paired free ends have holes wherein the paired free ends are doubled over and fastened to the cabinet with a screw.

5. The improved spa cover lift assembly of claim 1 wherein the weather protecting covering has spaced, elongated straps attached to the covering wherein the straps of at least the lower half-segment of the cover depend at the side of the spa where the folded cover is stored and attach to the spa cabinet wherein the folded cover is limited in horizontal displacement when pivoting the spa cover to its storage position.

6. The improved spa cover lift assembly of claim 1 wherein the covering is fabricated of a weather protecting material and the straps are fabricated of a weather protecting material similar to the covering material.

* * * * *